United States Patent [19]

Alexander et al.

[11] 4,339,211

[45] Jul. 13, 1982

[54] FLEXIBLE LEADER

[75] Inventors: P. Todd Alexander, King of Prussia, Pa.; Kurt H. Roth, Mississauga, Canada

[73] Assignee: Exxon Research & Engineering Co., Florham Park, N.J.

[21] Appl. No.: 61,880

[22] Filed: Jul. 30, 1979

[51] Int. Cl.[3] ..... B41J 35/04

[52] U.S. Cl. ..... 400/248; 400/208

[58] Field of Search ..... 400/194–196.1, 400/208, 248; 226/198; 242/157 R

[56] References Cited

U.S. PATENT DOCUMENTS

| | | | |
|---|---|---|---|
| 3,850,358 | 11/1974 | Nettles | 226/198 |
| 4,047,607 | 9/1977 | Willcox | 400/208 |
| 4,047,608 | 9/1977 | Willcox | 400/208 |
| 4,203,676 | 5/1980 | Hatsell | 400/208 |

OTHER PUBLICATIONS

*Foxfire* 3, Anchor Press/Doubleday, Garden City, New York, 1975, pp. 200, 201, 204, 205.

*Primary Examiner*—Paul T. Sewell

*Attorney, Agent, or Firm*—Kenneth R. Schaefer

[57] ABSTRACT

An improved flexible leader particularly suited for use in conveying the ink ribbon from a ribbon cartridge to the print point of a printing machine or typewriter is disclosed. Preferably, the leader is formed as an integral member having discontinuities therein defining bending points at which said leader is flexible. The leader can be flexed in only one direction, whereby the inked surface of a typing ribbon is never in contact with said leader, thus preserving its integrity.

11 Claims, 13 Drawing Figures

FLEXIBLE LEADER

FIELD OF THE INVENTION

This invention relates to the handling of a flexible ribbon or tape, and more specifically, to the storage and transport of such ribbon or tape. The invention also relates to the storage and transport of ribbon or tape of the type utilized in serial impact printers.

BACKGROUND OF THE INVENTION

A typewriter as well as other forms of serial impact printers typically includes provision for relative motion between the impact means and the print receiving means so that the characters may be printed along a line. Commonly, of course, in older style typewriters, the print receiving medium is moved with respect to the character elements which remain stationary. That is, the platen and paper move with respect to the frame of the machine while the character elements are substantially fixed. More commonly today in the design of typewriters and serial impact printers, the print elements are moved with respect to the platen. This is particularly important in certain typewriters and printers associated with word processors which are required to operate at very high speeds and to print in an automatic memory mode. In order to further increase the speed of such printers, it is desirable to reduce the inertia of all moving parts so as to require less force for starting and stopping these moving parts in operation, the mechanical operations being a limiting factor in the speed of such machines. Therefore, it has been found desirable to move the print element rather than the platen with respect to the frame of the machine, since the print element in general may be of lighter weight.

It has also been found desirable that the printing ribbon which passes between the print receiving means and the character elements be stored in a stationary position with respect to the frame of the machine so that this too allows a reduction in the inertia of moving parts. This has been accomplished as disclosed in copending applications Ser. No. 833,270, filed Sept. 14, 1977 and Ser. No. 833,257 filed Sept. 14, 1977 now abandoned by providing flexible leaders which guide the printing ribbon between a stationary ribbon cartridge and movable print point. However, in order for these leaders to function properly, it is important that the leaders bend in only one direction (i.e., no reverse bending) so as to assure that the ink side of the ribbon will not contact the leader where the leader forms an enclosed channel. It is also important in some instances to assure that the leader has a uniform bending radius.

OBJECTS OF THE INVENTION

It is an overall object of this invention to provide improved leader means of the type which may be utilized for guiding ribbon between the stationary storage area and a location movable with respect to the storage area.

It is a still more specific object of this invention to improve the leader means by facilitating manufacture thereof.

It is also a specific object of this invention to improve the leader means by reducing the cost of manufacture.

It is a further object of this invention to achieve the foregoing while still attaining the design criterion of leader bending in only one direction.

It is a still further object of this invention to achieve the foregoing while permitting the leader means to bend along a predetermined path.

SUMMARY OF THE INVENTION

In accordance with the above and other objects of the invention, the leader means comprises an integral member having discontinuities therein for controlling bending thereof.

In a preferred embodiment of the invention, portions of the integral member adjacent the discontinuities abut one another when the integral member assumes a rectilinear, i.e., straight line configuration, so as to prevent reverse bending. In accordance with one important object of the invention, the discontinuities may also serve to define hinge points so as to define bending along a predetermined path.

The discontinuities of the preferred embodiment may comprise slits in the walls of an extruded integral member which forms a channel where the sidewalls of the channel are L-shaped in cross-section so as to enclose at least a portion of the ribbon. The base of the channel comprises a flexible web of material bends so as to form hinge points adjacent the slits. By locating the slits at regular integrals, uniformity in bending may be achieved. The base of the channel may also include longitudinally extending ridges so as to minimize friction between the leader means and the ribbon.

BRIEF DESCRIPTION OF THE DRAWING

The invention will be better understood by referring to the accompanying drawing, in which:

FIG. 5A is a top view of a ribbon cartridge similar to that shown in FIG. 5, except that it is useful with magnetic tape;

Figure 8:
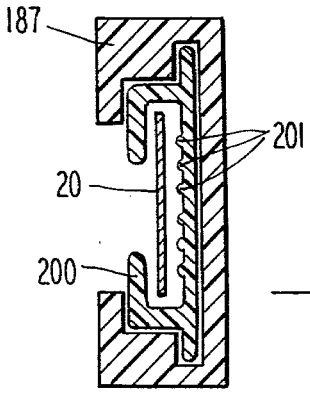

FIGS. *7a* and *7b* are partial top views of a portion of an end of the ribbon locator;

FIG. 8 is a sectional view taken along line 8—8 of FIG. *7b;*

Figure 9:
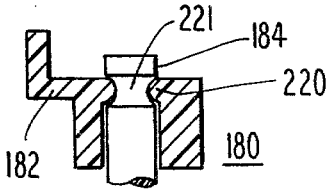

FIG. 9 is a sectional view taken along line 9—9 of FIG. *7a;*

Figure 10:
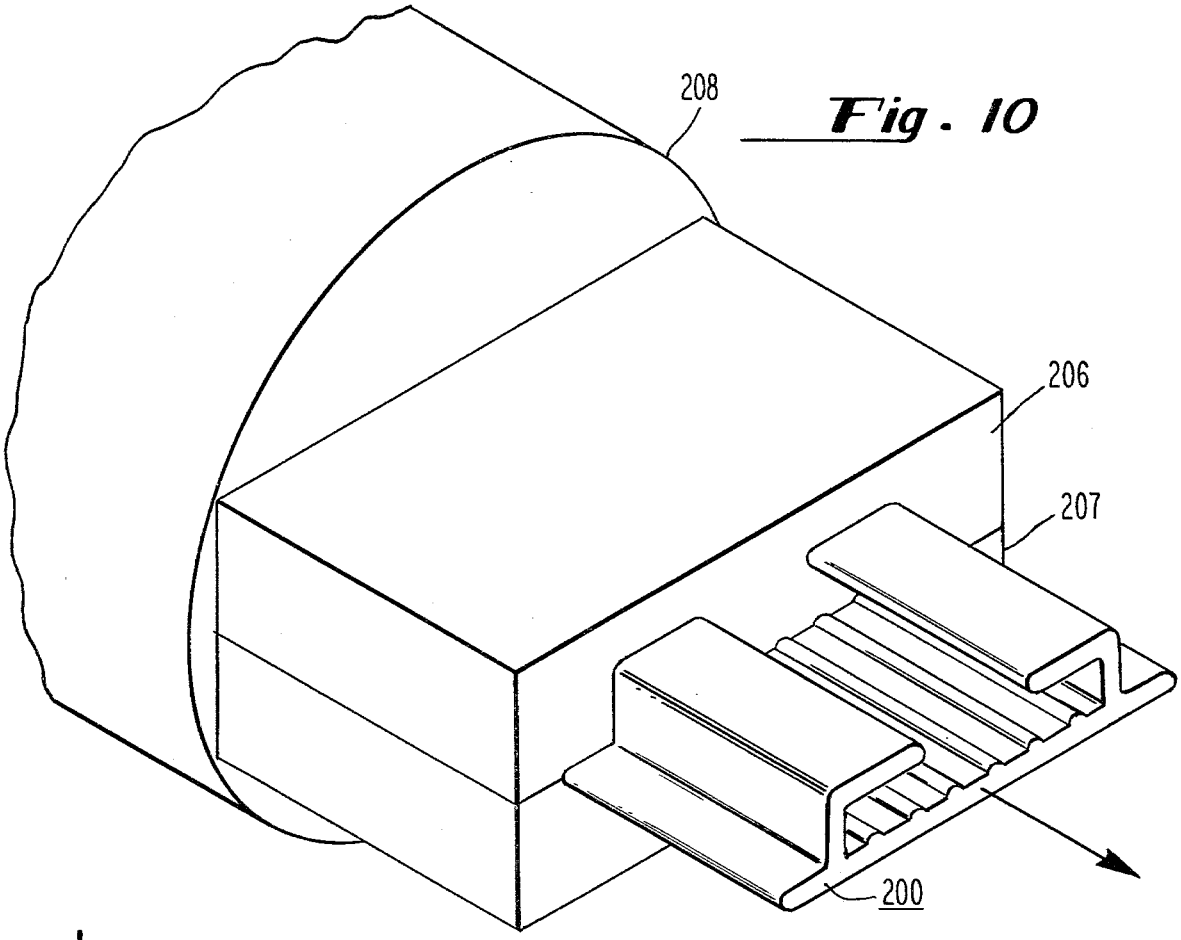
Figure 11:
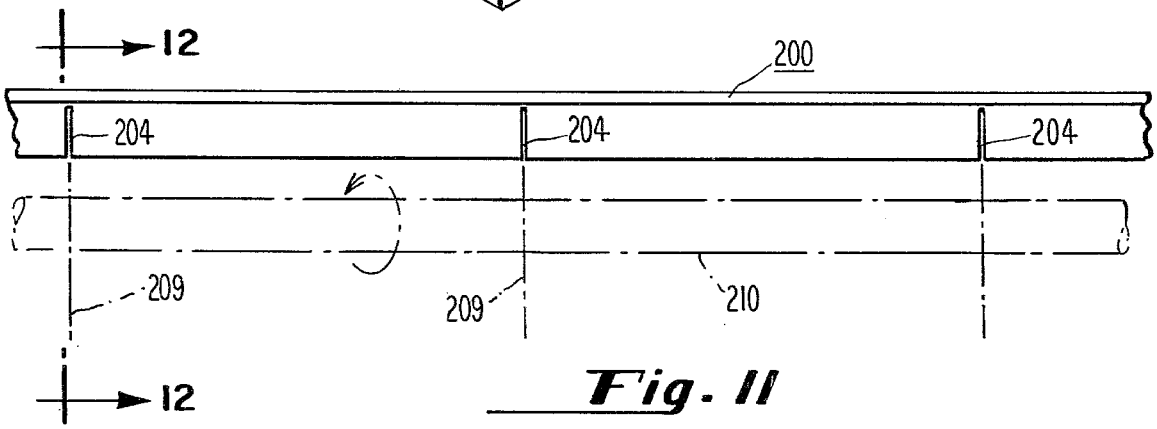

FIG. 10 is a perspective view of a first step in the method of making the leader;

FIG. 11 is a side view of a second step in the making of the leader; and

Figure 12:
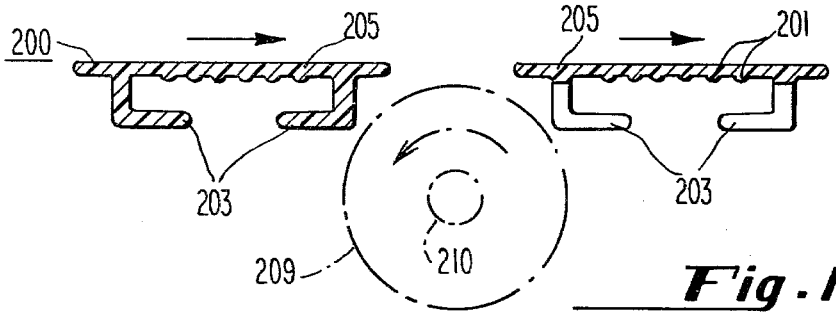

FIG. 12 is a sectional view taken along line 12—12 of FIG. 11.

DESCRIPTION OF THE PREFERRED EMBODIMENTS

Figure 1:
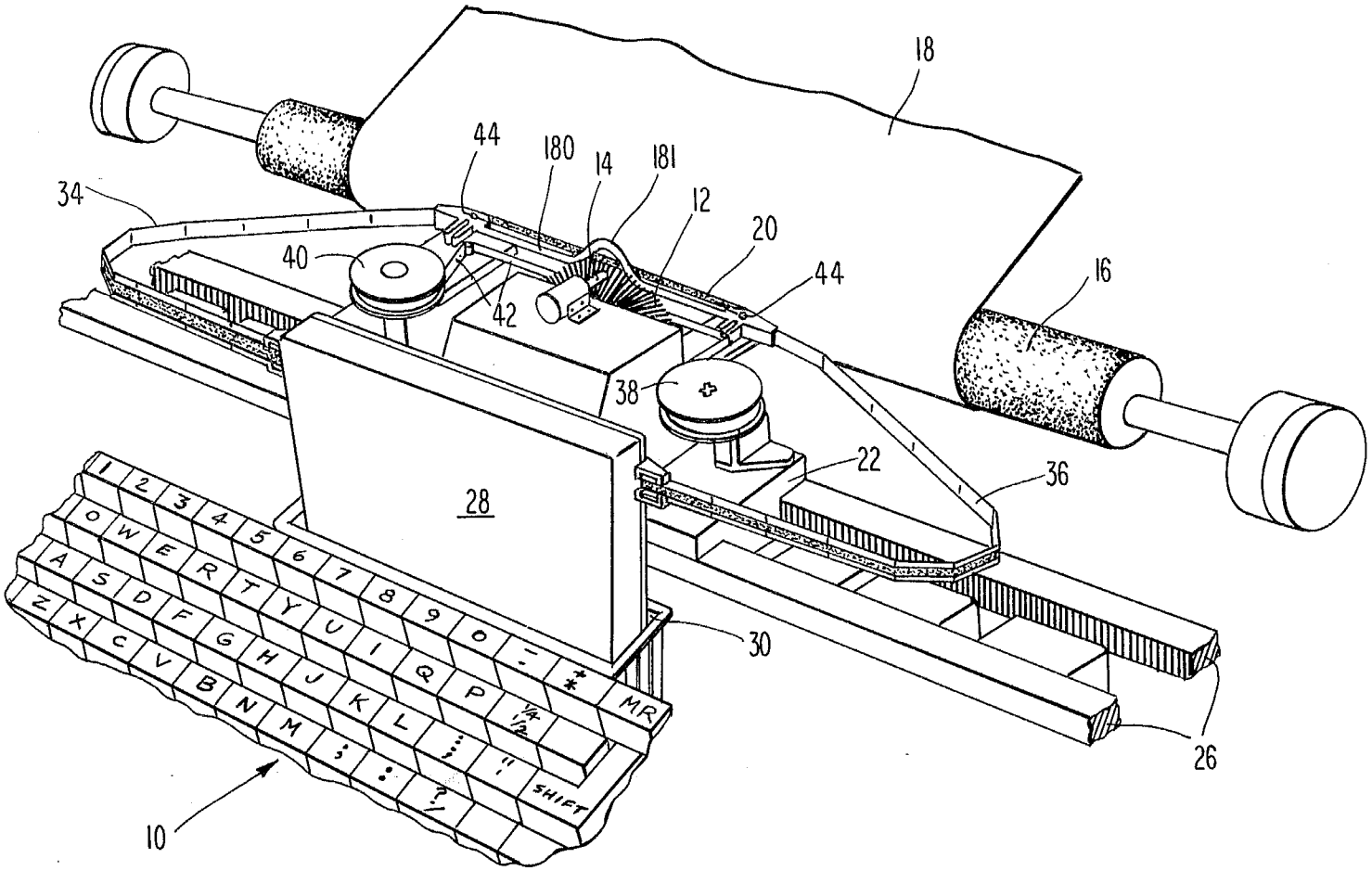
FIG. 1 represents a perspective view of a cartridge embodying the invention in a typewriter.

Referring now to FIG. 1, the overall arrangement of a serial impact printer in the form of a typewriter according to the present invention is shown. This typewriter comprises a keyboard 10 which controls the motion of a print wheel 12 which preferably comprises a plurality of spokes having character elements formed at their ends and adapted to be impacted by a hammer 14 in order to drive a selected character element against a platen 16 over which a sheet of paper or other print receiving medium 18 may be interposed, although other character print and paper support means are within the scope of the invention. A print ribbon 20 is interposed between the character element 12 and the paper 18 so as to leave an inked impression corresponding to the character elements selected. It will be observed that in FIG. 1 the ribbon is shown being disposed at rather below the print point defined by the position of the hammer 14. This is so that the operator of the typewriter can see what he or she has typed. In operation, the ribbon 20 is raised by lifter means (not shown) when the hammer 14 is about to impact the character element 12 and juxtaposed with respect thereto. The ribbon is carried by locator means 180 which is provided with an uplifted portion 181 under which the hammer and character element may pass on their way to the paper 18. The locator means 180 is mounted by means of posts 44 on a moving cartridge 22 desirably driven by a linear stepper motor 26. The ribbon is then passed through flexible leaders 34 and 36 which are connected in turn to a ribbon cartridge 28 which is mounted within a receptacle 30. In this way, when the carriage 22 moves back and forth with respect to the frame of the typewriter and the paper 18, the flexible leaders 34 and 36 permit the locating means 180 to move with the carriage 22 while the cartridge 28 remains fixed, the flexible leaders 34 and 36 providing the interconnection therebetween.

There may also be desirably mounted on carriage 22 an erase ribbon 42 which may be supplied from a reel 38 and taken up by a second reel 40 and used to either overprint a letter struck in error or may be used to remove it, depending on the type of ink supplied by the ribbon.

It will be observed that in FIG. 1 flexible leaders 34 and 36 comprise a series of comparatively short straight sections rather than a continuous curve. This will be explained in further detail below and is found to be a desirable method of manufacture of such flexible leaders.

Figure 2:
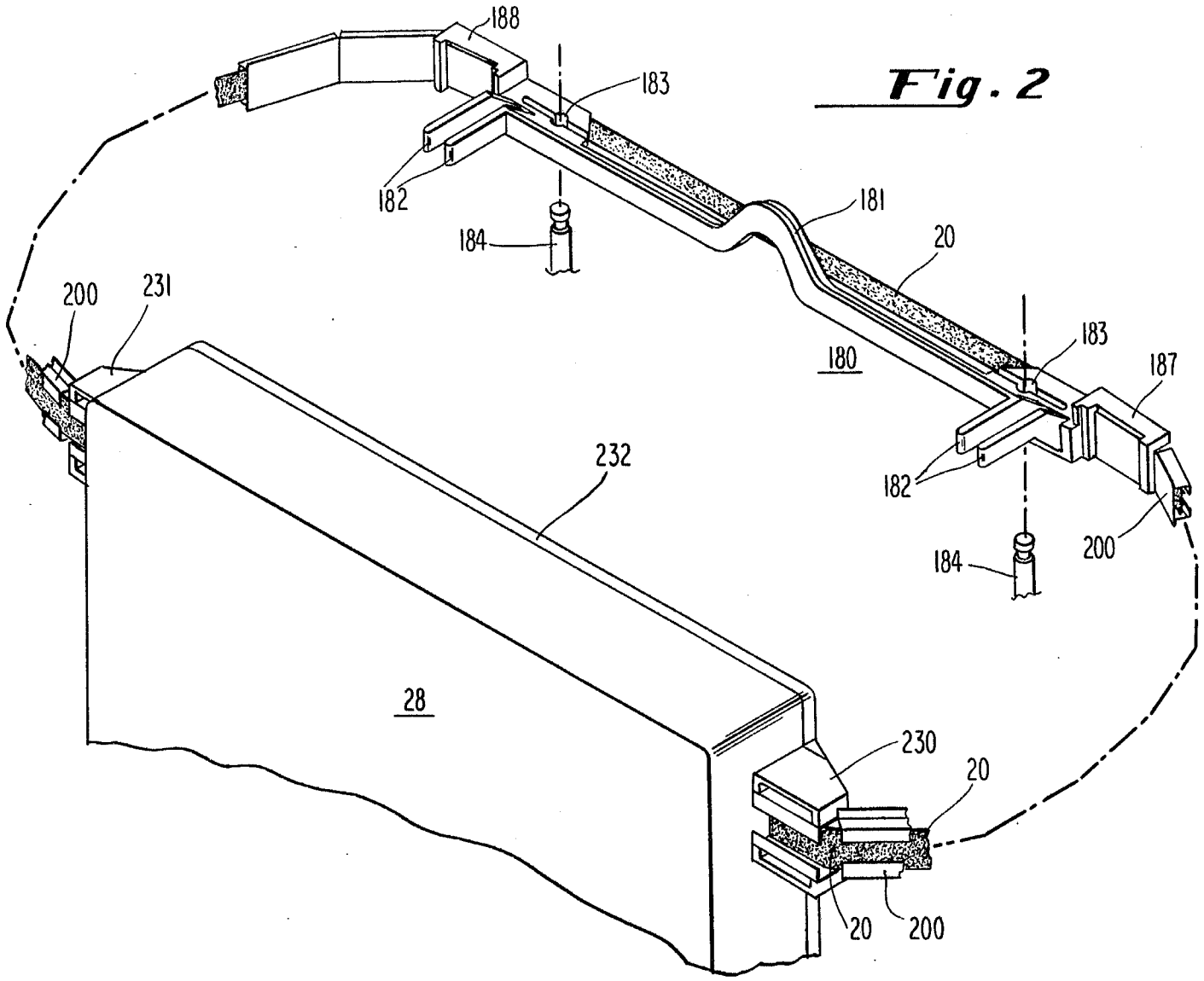
FIG. 2 represents an enlarged perspective view of the cartridge of FIG. 1 including ribbon locating means and ribbon guide means.

Referring now to FIG. 2 details of the cartridge 28 and ribbon locator 180 are shown. The cartridge 28 is connected to the flexible leader 200 by means of mounting structure 231 and 230. These are desirably mounted on the main section of the cartridge 28 so that the lid of the cartridge 232 may be made a simple part. Ribbon 20 is fed through first flexible leader 200 to locator 180 and returns by means of second flexible leader 200 back to cartridge 28.

Locator 180 comprises a central section spacing ends 188 and 187 apart. These ends are adapted to mate with corresponding pieces of leader 200. The ends 187 and 188 are provided with shaped notches 183 which engage posts 184 which are mounted on the carriage of the typewriter and are, as discussed above, lifted when typing is performed so as to interpose the ribbon 20 between a selected character element and paper 18. A raised central portion 181 of the locator 180 is provided so that the hammer 14 and character element 12 may pass therethrough on their way to impact the paper. Desirably, the ends of the locator 180 are provided with fingers 182 which may be operated by the operator when changing ribbons in order to open notches 183 so as to disengage locator 180 from posts 184. This feature which forms the invention of copending application Ser. No. 061,454 filed July 27, 1979 will be explained in further detail below.

Figure 3:
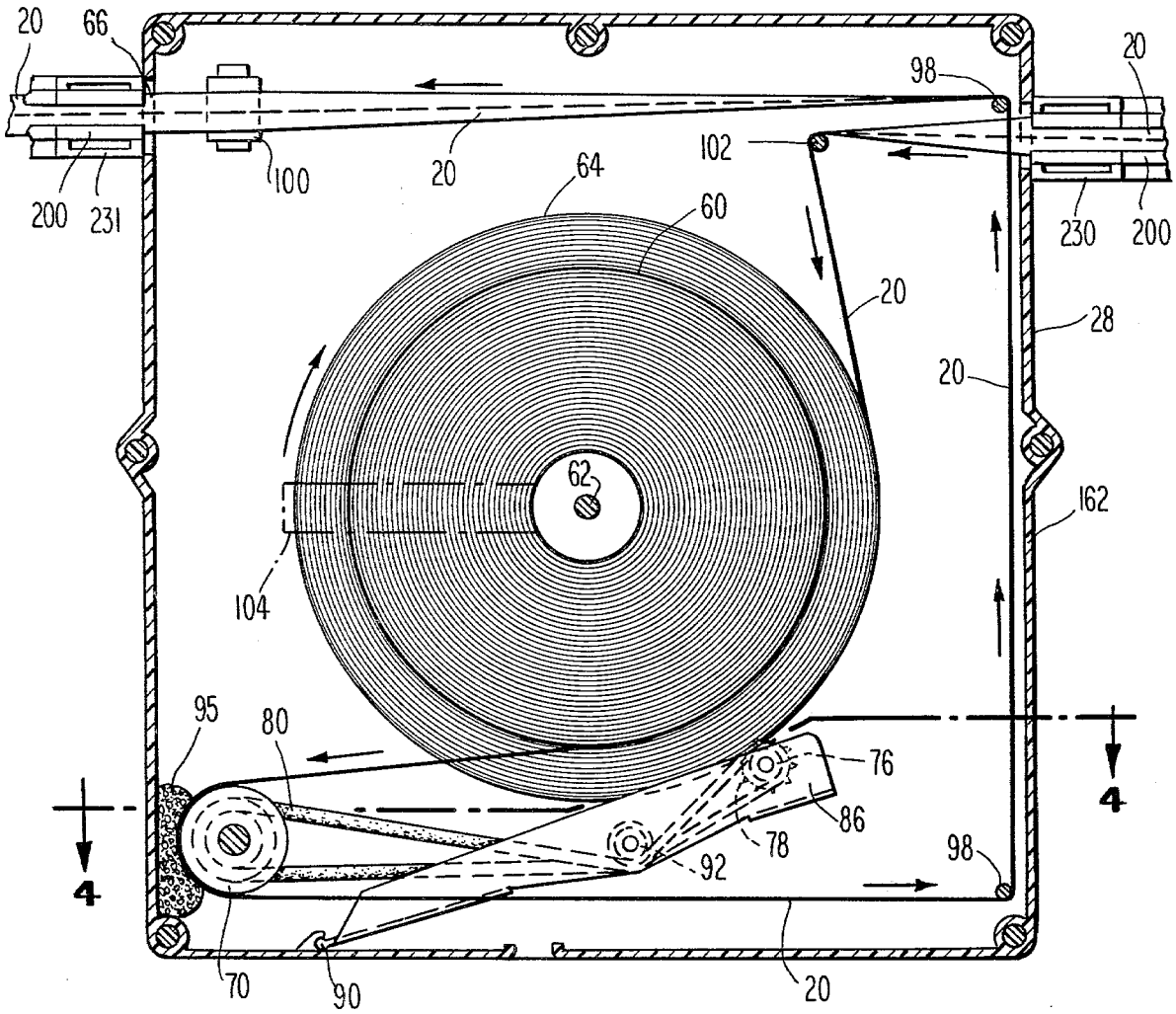
FIG. 3 represents a sectional view of the cartridge of FIGS. 1 and 2.
Figure 4:
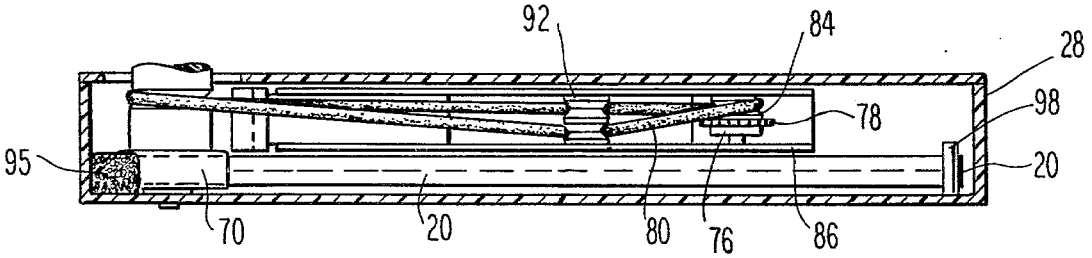
FIG. 4 represents a sectional view of FIG. 3 taken along line 4—4.

Referring now to FIGS. 3 and 4, internal details of the cartridge 28 are shown. The ribbon 20 is shown being unwound from a supply reel 60 by means of a capstan 70 which is desirably driven by a stepper motor mounted on the typewriter (not shown). Ribbon 20 then passes around two guide posts 98, over a roller 100, and exits the cartridge 28 by means of leader mounting structure 231 and leader 200, thence to pass to the print point. After being typed upon, the ribbon 20 is returned, again via leader 200 and leader mounting structure 230, over a post 102 and onto a take-up reel 64. Said supply and take-up reels 60 and 64, respectively, (which in a preferred embodiment are flangeless coils of ribbon) are mounted concentrically on a hub 62 and are both driven by means of the stepper motor, not shown, acting on capstan 70. However, while the capstan 70 directly pulls on the tape to supply it, the take-up is driven by means of an intermediary O-ring 80 and a star wheel 76 which is provided with teeth 78 which engage the typed-upon ribbon as it is wound onto the take-up reel 64. Said O-ring may desirably be passed over an intermediate pulley 92 which may be arranged so as to exert an inward tension (i.e., a tension acting toward the hub 62) on the arm 86 on which the star wheel 76 is mounted so as to keep the star wheel 76 in engagement with take-up reel 64. It is desirable to make the star wheel 76 by an integral molding process, whereby a plastic wheel is formed around a stamped metal star; in this way, an effective and unitary construction may be formed simply and inexpensively. It will be observed from FIG. 4 that the capstan is shown as comprising a resilient band around its lower circumference which drives the inked ribbon. It is also, in some circumstances, desirable to form this tire integrally with the capstan by means of an integral molding process. In other cases, a resilient band of the proper size may be slipped over the capstan.

In some cases, it is useful as well to insert a pad of foam 95 between the capstan 70 and the wall of the cartridge 28 in order to both exert a damping force on the ribbon so that when the stepper motor steps the capstan the tape does not tend to free-wheel ahead, and also to exert a force tending to push the ribbon 20 into frictional engagement with capstan 70 so that the capstan 70 may drive the ribbon 20. This is discussed in greater detail in copending application Ser. No. 061,879 filed July 30, 1979. A second possibility is that the returning typed-upon ribbon 20 may be given a contour by stretching it beyond its elastic limit so as to make it more suitable for rewinding. For further details on this subject, see copending application Ser. No. 061,875 filed July 30, 1979.

Figure 5:
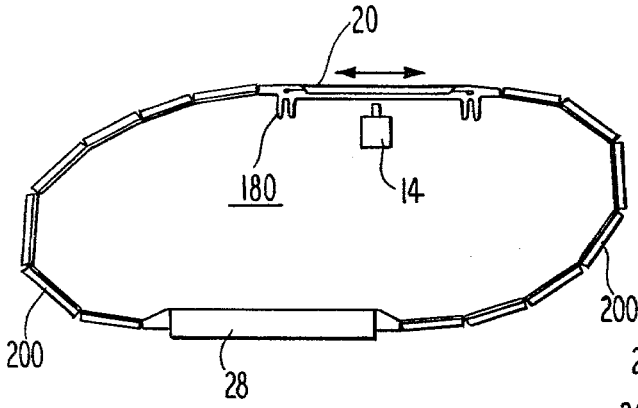
FIG. 5 is a top view of the cartridge of FIGS. 1-4 including the ribbon leader and ribbon locator thereof.

Referring now to FIG. 5, an overall schematic of the ribbon cartridge system of the invention is shown. The ribbon is both supplied from and taken up in cartridge 28 and passes through leader 200 on its way to and returning from the print point which is symbolized by hammer 14. The ribbon 20 is exposed in the region of the print point by locator 180 which is shown in further detail in FIG. 2. An arrow is provided showing that the hammer and locator 180 move back and forth with respect to the cartridge 28, as is permitted by the flexibility of leader 200. As discussed above, the leader 200 essentially comprises a number of short sections which are substantially rigid but which are hinged one to the next. This is made readily possible by the design of the leader used, which is shown in further detail in FIG. 6.

Figure 6:
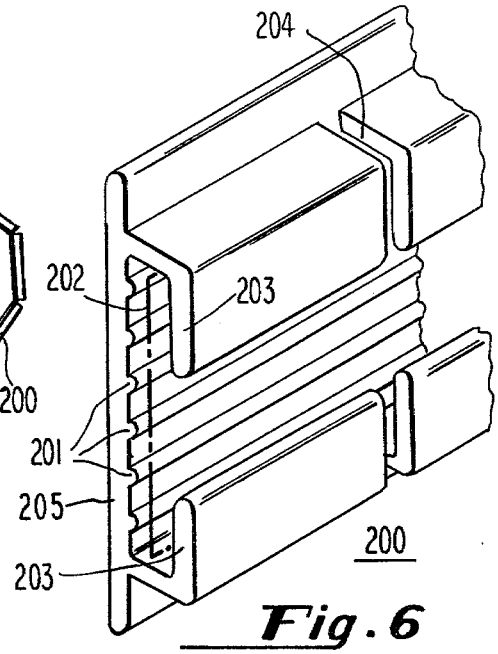
FIG. 6 is an enlarged perspective view of a portion of the leader.

Referring to FIG. 6, it will be observed that the leader 200 comprises a flat web section 205, and uplifted L-shaped sections 203 within which a ribbon (indicated schematically by a dot-dash line 202 rides. Slits 204 are provided in the uplifted L-shaped portions 203. The slits 204 allow the web 205 to become a hinge at each slit 204, thus permitting the leader 200 to comprise a number of short, comparatively rigid pieces but provide a flexible ribbon path since the leader 200 will not flex other than where slit due to the presence of the L-shaped enclosing means 203; the slits 204 together with the enclosing means 203 can be said to form hinge points. The slits 204 are shown rather wider than is desirable, for clarity; they should not be so wide as to allow reverse bending of leader 200, i.e, the extruded material on opposite sides of the slit should abut when the leader 200 is straight. Desirably, as well, a number of longitudinally-extending ridges or bumps 201 on the web 205 are provided so that the ribbon is not in direct engagement with the web 205 thus prohibiting planar frictional contact.

As shown in FIG. 5, the leader 200 is arranged in such a way that the slits 204 open to the outside of the roughly circular path formed by the leader 200. In this way, the inked side of the ribbon faces to the outside of the circle and is not contacted by the ridges or bumps 201, if such are provided, or by the inside of the web 205, if the bumps 201 are not provided. Furthermore, the formation of the slits 204 only on the outside of the web means that the curvature of the leader 200 is always inwards; that is, the enclosing portions 203 on adjacent sections of the leader 200 abut when the leader 200 is substantially straight, thus preventing reverse curvature; in this way, the inked portion of the ribbon at no time tends to contact the inside portion of uplifted guide areas 203, so that the ink does not tend to rub off on the leader.

As will be apparent to those skilled in the art, various plastics materials and plastics forming methods are useful in the manufacture of the leader of the invention 200. For example, propylene and polypropylene plastics are well known to have properties of flexure making them suitable for hinges such as those formed by the cutting of slits 204. Similarly, well known methods for forming are useful in the practice of the invention; in particular, the leader 200 may be made by a one-step extrusion process, as is discussed in detail below.

Figure 7A:
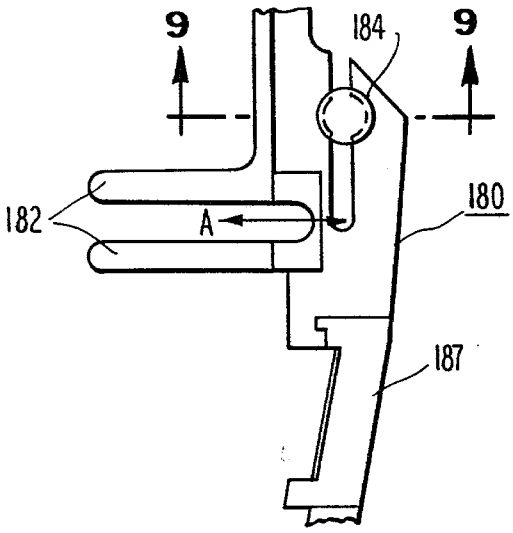
Figure 7B:
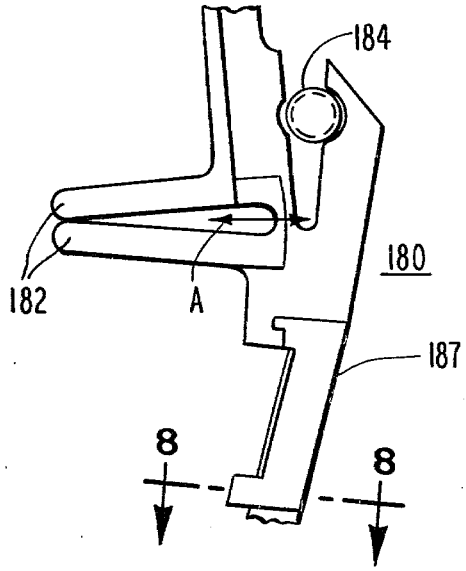

Referring now to FIGS. 7*a*, 7*b* and 9, certain other details of the ends of the locator 180 are shown which form the subject matter of the aforesaid application Ser. No. 061,454. Comparison of FIGS. 7*a* and 7*b* show how the locator 180 is releasably engaged by pins 186 on the carriage 22. FIG. 9 shows how a ridge 220 formed on the locator 180 engages a neck 221 in the pin 184 so as to firmly affix it thereto. It will be observed that fingers 182 in FIG. 7*a* are shown more or less parallel, whereas in FIG. 7*b* they are shown pulled together, as they would be by the action of the operator's hand. The engaging arms of the end of the locator 180 would then open out thus disengaging the ridge 220 (FIG. 9) on the locator from the neck 221 on the pin 184 allowing the locator to be removed. If the same action is performed simultaneously on both ends of the locator 180, it may be removed from the pins 184 hence disengaging the locator from the carriage 22 of the typewriter. The action of bringing the fingers 182 closer together opens the arms of the end of the locator 180 if the end is so designed that it flexes in the proper space indicated by a line A. This is simply done by making A the weakest point between the two fingers 182. That is, of course, the fingers 182 must themselves have a larger cross-sectional area than area A otherwise they would flex rather than A which would not achieve the desired result. However, this is a simple matter of design and can easily be arranged by those skilled in the art of plastic molding. A cross-sectional view through the pin 184 is shown in FIG. 9 where it is made clear that the ridge 220 on the end of the locator 182 engages the neck 221 of the pin 184. A detail of how the guide 200 fits into the end of the locator 187 is also shown as FIG. 8. There the end of the locator is 187, the guide 200 and the ribbon 20 therewithin. As both locator 187 and guide 200 are desirably molded of plastic, it is a comparatively simple matter to design them in such a way that a snap or friction engaging fit of sufficient strength can be arranged which will permit the carriage to move back and forth with respect to the cartridge without their coming apart.

Turning now to FIGS. 10–12, an exemplary process for the manufacture of the leader 200 of the invention is shown. FIG. 10 shows a perspective view of a section of leader 200 emerging from an extruder comprising a two-piece die 206, 207 and an extruder box 208. Typically, in accordance with teachings in the prior art, plastic is fed into the extruder box 208 and warmed to the point where it can be pushed through a die 206, 207 yielding a formed product; in this case, leader 200. An arrow is provided in FIG. 10 to show that the leader 200 is emerging from the die 206, 207. In FIGS. 11 and 12, the leader 200 is shown being cut by knives 209 (shown in phantom) in order to form slits 204 which define discontinuities in the enclosing means 203 so as to define hinge points in the web 205 of the leader 200. In FIG. 11, a section of leader 200 is shown being slit at a number of points to form slits 204 corresponding to the cuts made by knives 209 which may be a gang of flat knives, or be rotated on a shaft 210. Thus, the shaft 210 and the blades 209 may form a gang knife. It will be apparent to those skilled in the art that if desired the blades 209 of the gang knife may be arranged regularly (that is, evenly spaced) or irregularly, if desired. FIG. 12 shows a cross-sectional view along the line 12—12 in FIG. 11. There is depicted a pair of cross-sectional view of the leader 200, on the left before, and on the right after, being cut by a blade 210. It will be apparent that the blade 209 desirably cuts (but does not remove any of) the enclosing means 203 of the leader 200 to a depth such that the bumps 201 formed in the web 205 of the leader 200 are not themselves cut, thus forming a hinge portion at a discontinuity formed by the cut whereas the leader 200 can bend flexibly. However, in some cases it may be preferable to cut into the bumps 201.

It will be appreciated that there are numerous modifications and variations that can be made to the invention as disclosed without departing from its essential scope.

Although the leader means has been shown and described and various alternatives considered with respect to that preferred embodiment, it will of course be understood that the leader itself may vary substantially in appearance. For example, the nature of the channel sidewalls might vary considerably and the sidewalls themselves need not necessarily include the uppermost portion which partially encloses the ribbon. If enclosure is required, such enclosure may be provided by a separate member which covers the open end of the channel. Another possibility for variation would involve the spacing of the slits 204. It has been found for applicant's purposes that it is adequate to space the slits evenly (i.e., at regular intervals), thus allowing the cutting of the slits to be performed on somewhat simpler machinery. However, in some circumstances it may turn out that it is better to cut the slits at irregular intervals so as to more particularly define the path taken by the leader 200 and hence by the ribbon 20 therewithin. Moreover, it will be appreciated that there are numerous modifications which can be made to the locating means used to secure the ends of the leader 200 to the cartridge 28 and to the ribbon locator 180. These means will desirably be snapped together such that no additional screws, assembly parts or adhesives are required; but it may be that in certain circumstances these are desirable alternatives.

A final possibility is that the leader and cartridge according to the invention may find use for conveying ribbon or tape between a source of supply and a point of use thereof in applications other than printing machines; for example, in some circumstances it might be desirable to transport magnetic recording tape to and from a cartridge in hinged flexible leaders. In particular, if a magnetic tape were of a type comprising a surface which was very easily damaged in handling, as are some types of inked printing ribbons, leaders formed so as to only be bendable in one direction would be useful in the direction and support of such tape on its way to a record/playback or read/write head. In such case the arrangement of parts would be as shown in FIG. 5A, a magnetic tape 20A being exposed to a magnetic head 14A. The magnetic tape 20A is directed from a cartridge 28A to a point of use and back by means of leaders 200A. A locator such as 180A may also be employed if desirable.

Therefore, the above description of the invention should be considered as exemplary only and not as limiting of its scope which is more properly defined by the following claims.

What is claimed is:

1. A printing apparatus of the type comprising means for support of a print receiving medium, laterally movable character printing means juxtaposed to said support means for establishing a laterally movable print location, a ribbon comprising a printing medium adapted to advance past the movable print location in printing relationship with the print receiving medium and the character printing means, stationary ribbon storage means, and leader means coupled between said storage means and said print location for guiding movement of said ribbon between said storage means and said print location, the improvement residing in said leader means comprising an integral member forming a channel having a base and sidewalls extending at least partially outwardly from said base and generally away from a center of curvature about which said leader bends during movement of said printing means past said print location, said sidewalls of said member having discontinuities therein the portions of said sidewalls adjacent said discontinuities abutting against each other when said integral member assumes a substantially rectilinear shape so as to control bending of said leader means in a manner to limit bending to only one direction as said printing means moves.

2. The apparatus of claim 1 wherein said discontinuities form hinge points in said integral member.

3. The apparatus of claim 1 wherein said integral member comprises a flexible web and enclosing means, said enclosing means having discontinuities therein.

4. The apparatus of claim 3 wherein portions of said enclosing means adjacent said discontinuities abut when the integral member assumes a substantially rectilinear shape so as to restrain bending to only one direction as said print location moves.

5. The apparatus of claim 3 wherein said discontinuities and said enclosing means form hinge points in said integral member.

6. The apparatus of claim 1 wherein said discontinuities comprise slits in said sidewalls.

7. In a ribbon supply apparatus of the type comprising a source of supply of ribbon, and a flexible leader for conveying said ribbon to a point of use, the improvement which comprises said leader being an integral member forming a channel having a base and sidewalls extending at least partially outwardly away from said base and generally away from a center of curvature about which said leader bends when conveying said ribbon to said point of use, said sidewalls having discontinuities therein about which said leader bends, the portions of said sidewalls adjacent said discontinuities abutting when said integral member assumes a rectilinear shape so as to restrain bending to only one direction as said ribbon is conveyed to said point of use.

8. The apparatus according to claim 7 wherein said portions are additionally enclosing means for carrying said ribbon.

9. The apparatus of claim 8 wherein said discontinuities and said enclosing means form hinge points in said integral member.

10. The apparatus according to claim 7 wherein said discontinuities form bending points in said integral member.

11. The apparatus of claim 7 wherein said discontinuities comprise slits in said sidewalls.

* * * * *